United States Patent [19]

Brown

[11] Patent Number: 4,681,786

[45] **Date of Patent: * Jul. 21, 1987**

[54] COVERINGS PROVIDING IMPACT SOUND ISOLATION

[76] Inventor: John G. Brown, 20205 State Line Rd., Harvard, Ill. 60033

[ * ] Notice: The portion of the term of this patent subsequent to Oct. 8, 2002 has been disclaimed.

[21] Appl. No.: 567,151

[22] Filed: Jan. 3, 1984

Related U.S. Application Data

[63] Continuation of Ser. No. 131,516, Mar. 18, 1980, abandoned.

[51] Int. Cl.[4] ..... B32B 3/10; E04F 13/08

[52] U.S. Cl. ..... 428/44; 52/309.13; 52/385; 52/390; 428/47; 428/49; 428/54; 428/77; 428/189

[58] Field of Search ..... 428/44, 49, 51, 54, 428/57, 189, 182; 52/384, 385, 389, 390, 403, 747, 309.13; 156/71

[56] References Cited

U.S. PATENT DOCUMENTS

| | | | |
|---|---|---|---|
| 3,335,048 | 8/1967 | Morain | 52/390 |
| 3,646,180 | 2/1972 | Winnick | 428/49 |
| 3,817,012 | 6/1974 | Wack | 52/389 |
| 3,902,293 | 9/1975 | Witt et al. | 428/201 |
| 3,988,187 | 10/1976 | Witt et al. | 428/53 |
| 4,546,024 | 10/1985 | Brown | 428/44 |

*Primary Examiner*—Paul J. Thibodeau

[57] ABSTRACT

A gravity-held-in-place-load-bearing-horizontal-tile-array over a horizontal-base-surface, typically a floor, which comprises an array of rigid tiles set on a horizontal-base-surface. The rigid tiles have edges positioned adjacent to the edges of adjoining tiles in the array, with the array of rigid tiles being separated from the horizontal-base-surface by at least a ⅛ inch thickness of horizontal-disassociation-cushing-layer. The tiles are adhesively joined at their edges to adjacent edges of adjoining tiles with an elastomeric sealant with adhesive properties. Accordingly, impact sound such as footsteps on the tiles passing through the horizontal-base-surface is substantially diminished by the thickness of the horizontal-disassociation-cushioning-layer, while the tiles form a dynamic, movable system, with the elastomeric-sealant-joints compensating without breaking of the joint or of tile as the tile is temporarily pressed by a footstep or the like into the thickness of the horizontal-disassociation-cushioning-layer. Also, thicker sections of generally rigid horizontal-rigid-foam-insulation may be placed under the array of tiles to provide thermal insulation between habitable spaces in addition to impact sound isolation between habitable areas.

20 Claims, 4 Drawing Figures

COVERINGS PROVIDING IMPACT SOUND ISOLATION

This is a file-wrapper-continuation of Ser. No. 131,516, filed Mar. 18, 1980, now abandoned

BACKGROUND OF THE INVENTION

Tile floors are desirable for many purposes, since they are easily maintained in clean condition and in a high level of appearance, and are less subject to wear than carpeted floors, where the appearance level is reduced rapidly to a generally lower level than when originally installed. Accordingly, tile floors are highly desirable for use in multi-story public and government buildings; public assembly buildings; community buildings; educational buildings; religious buildings, medical buildings and hospitals; commercial and mercantile buildings, such as, banks, eating and drinking establishments, stores; office buildings; and residential buildings, such as, apartments and condominiums, housing for the elderly, nursing homes, and private residences; particularly in arid and semi-arid areas with sand and other areas where blowing sand is a continuing problem. Likewise, tile floors are highly preferable from a maintenance and durability point of view for rental apartments and condominiums, public housing, nursing homes, and the like.

However, as a disadvantage to the currently available tile floors in multi-story structures, those above the first floor of a building are highly transmissive to impact sound generated, for example, by the shoe heels of a person walking across the tile floor (women with spike heels and men with metal clips), or other forms of impact on the floor. The sound is transmitted to the floor below, and in the event of a heavy traffic area such as a restaurant, dance floor, apartments, condominiums, nursing homes, hospitals, or the like, sound transmission through the floor below to occupied spaces below can be a very serious problem, requiring the installation of carpeting even when, for other reasons, carpet is undesirable or not the best answer. As a result of this, it becomes difficult to place a dance floor, or a high-traffic restaurant, hospital, nursing home or apartments on an upper floor of a multi-story building since there are strong reasons or personal preferences to leave such establishments uncarpeted but, rather, with hard surface, enduring floors. The occupants of the floor below may be seriously disturbed by the continuous transmission of the impact of footsteps on the tile.

Similarly, in multi-story apartments and condominiums where it is desired to keep maintenance costs to a minimum, the impact sound of footsteps and the like from the apartment overhead can generate excessive disturbing noise and a continuous series of tenant complaints, forcing the installation of carpeting, with its added expense, periodic clenaing, replacement costs, and the like.

While previous attempt have been made to produce tile coverings having high loss of impact sound from transmission to other occupied areas, particularly areas below the source of impact sound, they have not been very successful. For example, wood tiles have been placed on ½ inch plywood which, in turn, rests upon ¼ inch cork sheet lying on a wood or concrete structural subfloor. With this configuration, the sound damping has not been exceptionally high, and the problem of warping of the plywood requires the use of screws to hold the plywood in place, which, in turn, helps to transmit the impact sound to the structural subfloor.

In accordance with this invention, a horizontal-tile-array is provided having greatly reduced impact sound transmission through its horizontal-base-surface. If desired, this can be combined with improved thermal insulation or the floor supported on foam insulation, with or without a horizontal-disassociation-cushioning-layer, for impact sound isolation, and may be accomplished with a unique, dynamic system in which the tiles are resiliently carried upon the horizontal-base-surface. Despite this, in accordance with this invention, tile breakage, due to the receipt of an excessive load from a spike heel or a heavy woman or the like, can be essentially controlled or damped for good tile floor life, coupled with a greatly improved impact sound isolation.

DESCRIPTION OF THE INVENTION

In accordance with this invention, a gravity-held-in-place-load-bearing-horizontal-tile-array may be provided over a horizontal-base-surface which is typically a floor. An array of preferably rigid tiles is set on the horizontal-base-surface, with the rigid tiles having edges positioned adjacent to the edges of adjoining tiles in the array.

In this invention, the array of rigid tiles is separated from the horizontal-base-surface by at least a ⅛ inch thickness of horizontal-disassociation-cushioning-layer. The tiles are also adhesively joined at their edges to adjacent edges of the adjoining tiles with an elastomeric-adhesive-sealant, which provides the dynamic system mentioned above, providing accumulated-interactive-assemblage. When a heavy load is placed upon a small area of a tile, it will tend to sink temporarily into the horizontal-disassociation-suchioning-layer, usually in a nonuniform manner, since the load will rarely be placed in the exact center of each tile. The elastomeric-adhesive-sealant-joints between the adjoining tiles will correspondingly stretch or compress to adjust for the temporary deflection of the tiles, with the tops of the joints being in compression and the bottoms of the joints being in tension, or vice versa, to avoid breadage and rupture of the elastomeric-adhesive-sealant-joints between tiles, to disperse the stress, and to prevent breaking of the tiles which by nature are relatively brittle.

As a result of this, impact sound applied to the tiles and passing through the horizontal-base-surface is substantially diminished, being damped by the presence of the horizontal-disassociation-cushioning-layer and also due to the resilient, dynamic system utilized to join the tiles together.

Preferably, the horizontal-disassociation-cushioning-layer is a sheet of elastic foam, being preferably about ⅛ to ½ inch tick. Any suitable elastic foam may be used. Examples of preferred horizontal-disassociation-cushioning-layers which may be used include commercially available carpet foundation foam, for example, ¼ inch thick Omalon II (Spec 1, Spec 2, or Spec 3, Spec 2 being preferred.) This material is polyurethane and is sold by the Olin Chemical Company. Another suitable horizontal-disassociation-cushioning-layer is Contract Life 310 EPDM carpet pad, sold by Dayco Corporation. Polyurethane, polyethylene and polystyrene foams are also suitable. Other types of elastic foam material of a variety of chemical compositions may also be used and, if desired, solid elastomeric materials may also be used for the thickness of the horizontal-disassociation-cushioning-layer. The thickness of horizontal-disassociationcusioning-layer may be factory-manufactured rolled goods, flat or folded sheet, poured-in-place foams from jobsite pouring systems, or sprayed-in-place foams from jobsite spraying systems, as is the most convenient means, as long as it is of generally uniform thickness, durable in nature and of correct density to functionally support floor loads. Also elastic carpet pads may be used such as possibly rubberized animal hair, synthetic fiber, and/or India jute pads, flat sponge rubber, waffled sponge rubber, flat latex rubber, herringbone design rippled spong rubber, waffled EPDM polymer sponge, latex foam rubber, and the like.

The tiles used in this invention may be of any desired size, typically from 1 inch to 1 foot on a side or larger. Tiles of wood, composition, and cementitious materials up to 4 feet or 5 feet on a side will perform with this system of dynamic-interactive-fluidtight-flexible-joints. The tiles typically may be of rectangular, square, hexagonal, octagonal or triangular shape, although any other shape may be used, such as traditional shapes like Mediterranean, Spanish, Valencia, Biscayne, segmental, or oblong hexagonal. The tile may be of any material, i.e., commercially available quarry tile, ceramic tile, porcelain tile, vitreous tile, and the like. Stone tiles are also usable, for example, marble, slate, or granite. Also the tile may be terrazzo, concrete, plastic, or wood. Composition tile may also be used, and any other rigid tile.

The dynamic-interactive-fluidtight-elastomeric-adhesive-sealant which is used to join the tiles at their edges to adjacent edges of adjoining tiles may be preferably any type of adhesive-sealant which provides a good adhesive bond with each tile edge, is flexible when cured, is capable of taking the stress inherent within the dynamic moving action of this dynamic system, and will form a non-sticky, flexible surface coating. Typically, polysulfide or silicone sealants, or like materials, may be used, or flexible urethane sealants such as Vulkem 116, 227 or 45 as manufactured by Mameco International, which are generally preferred. Since, generally, elastomeric sealants can often be formulated from a variety of base ingredients to achieve a variety of functional purposes, any room-temperature-curing elastomeric sealant composition or like composition not requiring heat or pressure for curing and which exhibits the required functional characteristics may be used to form the dynamic-interactive-fluidtight-elastomeric-sealant with adhesive properties.

The dynamic-interactive-fluidtight-elastomeric-sealant may be applied between the tiles by any means, such as with a manual caulking gun or by pouring of joints. A pressurized gas pumping system for dispensing dynamic-interactive-fluidtight-elastomeric-sealant from a bulk container with gas- or air-operated guns is the technique which is generally preferable.

The spacing of adjacent tile edges is generally adjusted to permit the formation of a strong, dynamic-interactive-fluidtight-flexible-bond between the tile edges by the dynamic-interactive-fluidtight-elastomericsealant used. A typical spacing is about ¼ inch to ½ inch, except that for ceramic mosaic tiles and paver tiles, a spacing of approximately 1/16 inch is preferred. Such spacings also eliminate the need for thermal expansion and contraction joints.

It may be desirable to add a primer on edges of tile to insure a substantial adhesion by the dynamic-interactive-fluidtight-elastomericsealant to the tile edges, dependent upon the ingredients of the dynamic-interactive-fluidtight-flexible-sealant and the porosity of the tile being joined, as well as the recommendations of the sealant manufacturer. Where a primer is required, care must be used to insure keeping primer off the face of the tile.

In the interest of economy and simplicity, it is obviously desirable if at all possible to endeavor to select a sealant for a given tile, which has the other inherent functional characteristics required without requiring a primer. For example, the preferred urethane sealants listed do not require a primer when utilized with most non-porous tile such as ceramic tile, masonry tile, and the like.

It is preferable for the tiles to be free of adhesion to the horizontal-disassociation-cushioning-layer, and particularly free of any mechanical attachment means which can serve to transmit the impact noise to the horizontal-base-surface, typically the structural supporting subfloor. In other words, in this invention it is preferably contemplated for the tiles to "float" by gravity, friction, and accumulated-interactive-assemblage on the thickness of the horizontal-disassociationcushioning-layer, being joined together only at their edges by a dynamicinteractive-fluidtight-elastomeric-sealant bond to the edges of the neighboring tiles. Thus a dynamic system is formed which dynamically responds to foot traffic or rolling loads in all of the joints of dynamic-interactive-fluidtight-elastomeric-sealant between the rigid tiles, so that the external and internal moments created by the loads, which generate tension and shear on the tiles and joints, can be dispersed through the flexible system among the various tiles by means of a continuous dynamic dissipation (much like continuous beam action which has a greater strength to size than a simple beam) between adjacent tiles, dissipating the stress in various directions from the load to the adjacent tiles.

The dynamic-interactive-fluidtight-elastomeric-sealant bonds between tiles sustain internal shear force in the elastomeric-sealant-joints, to provide flexible joints with the top of the joint in compression and the bottom of the joint in tension at one moment as a foot steps on or near the tile, and, at the next moment, the compressions and tensions may be reversed. However, the deflection is partially equalized, and the stresses dispersed to surrounding tiles by the system of this invention, thus greatly reducing the possibility of breakage of rigid tiles or the dynamic-interactive-fluidtight-flexible-bonds, despite their involvement in a dynamic system.

The plurality of dynamic-interactive-fluidtight-elastomeric-sealant-joints between the tiles combined with the thickness of the horizontal-disassociation-cushioning-layer under the tiles distributes stress through "wavelike" damping or dispersing action to the adjacent tiles, even when the tile is heavily pressed in a tilted position, in cooperation with the dynamic-interactive-fluidtight-flexible-joints, thus distributing loads to adjacent tiles and controlling the tilting of individual tiles and greatly reducing the possibility of snapping of tiles which are relatively brittle by nature.

Most underlayments of plywood, particleboard, hardboard, and the like, warp readily when any material is adhered to only one side or when moisture or moist vapor is exposed to only one side, making it necessary to adhere these rigid boards by adhesive to the structural subfloor or mechanically fasten these rigid boards to the structural subfloor, which forms a bridge for transmission of impact sound. By the use of thin, generally flexible asbestos-cement board, ⅛" tempered hardboard or thin composition board, or the like, with slight flexibility and non-warping, with a more inert nature and imperviousness to moisture while being limp, it is possible to keep these flexible boards flat with or without splice joints at all edges and held in place by the tile covering "floating" by gravity over the top of the flexible boards. The flexible boards actually exhibit some flexibility to sink into the thickness of the horizontal-disassociation-cushioning-layer under a load.

Alternatively, it may be desired to replace or add to the thickness of horizontal-disassociation-cushioning-layer of this invention by the addition of at least a ¾ inch or greater thickness of horizontalrigid-foam-insulation, such as polystyrene foam board, polystyrene bead board, urea-formaldehyde foam board, polyurethane foam board, polyisocyanurate foam board, phenolic foam board, and the like, foamed-in-place rigid urethane foam and the like, urethane pour systems ad the like, separating the rigid tiles and the base surface. The tile array shown in the drawings is adhered together by the perimeter joints and loose laid over any type of rigid-foam-insulation, such as is listed above. The dynamic-interactive-fluidtight-elastomeric-sealant-joints between the tiles are still preferably used to compensate for stresses that may be generated by deflection of the relatively rigid foam which, however, still is subject to some deflection under heavy loads. An advantage of this system is that thermal insulation is provided as well as impact noise isolation. This thermal insulation can also be beneficially installed below the horizontal-disassociation-cushioning-layer.

THE FIRST EMBODIMENT OF THIS INVENTION

Figure 1:
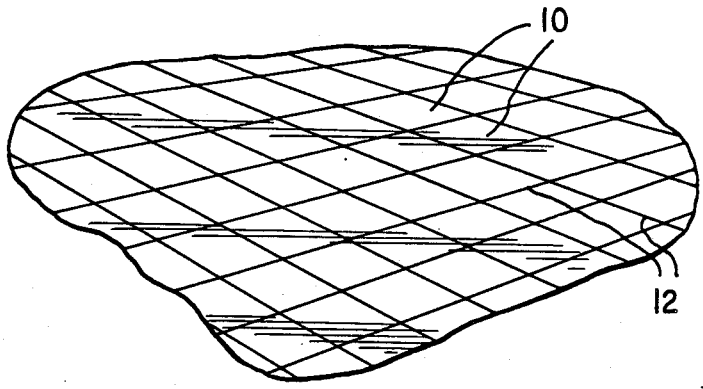
FIG. 1 is a perspective view of a tile covering in accordance with this invention.

Referring to the drawings, FIG. 1 shows a tile covering on a floor, which comprises an array of horizontal-individual-tiles 10 which may, for example, be quarry tiles six inches square and ½ inch thick.

Horizontal-individual-tiles 10 are shown to be adhesively joined at their edges 12 to the adjacent edges 12 of adjoining tiles with a dynamic-interactive-fluidtight-elastomeric-sealant 14 which may, for example, be a commercially available polyurethane sealant, applied by a manual or pressure application technique.

THE SECOND EMBODIMENT OF THIS INVENTION

Figure 2:
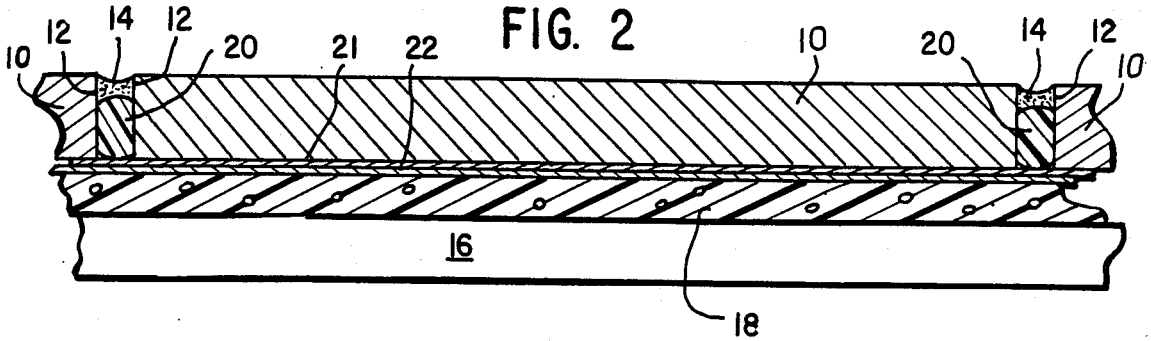
FIG. 2 is an enlarged, transverse sectional view of the tile covering of this invention, shown resting upon a horizontal-base-surface.

Referring to FIG. 2, horizontal-individual-tiles 10 are set on a horizontal-base-surface 16, such as the building structural subfloor or floor of the room in which the horizontal-individual-tiles are set, being separated from the horizontal-base-surface 16 by a sheet of horizontal-disassociation-cushioning-layer (foam) 18, which is shown to be about ¼ inch thick, but which may be from ⅛ inch to ½ inch thick, and rests on horizontal-base-surface 16. The thickness of horizontal-disassociation-cushioning-layer 18 may have flat surfaces or may have an irregular upper or lower surface, if it is desired. For example, flexible plastic foam mats with waffled, herringboned or corrugated surfaces are available, and may be used herein.

Horizontal-disassociation-cushioning-layer 18 is provided with one ore more (preferably two) optional sheets 21, 22 of flexible plastic slip sheets made, for example, of polyethylene, polyolefin or any other durable plastic or durable flexible composition sheet, or the like, which are provided to avoid wear of the horizontal-disassociation-cushioning-layer 18 top or bottom surface and to dissipate the minute frictional movement due to tile depression as the horizontal-individual-tiles 10 are depressed to be minutely shifted by dynamic movement of horizontal-individual-tiles 10 from footsteps or other pressures on the horizontal-individual-tiles 10. Horizontal-disassociation-cushioning-layer 18 may have protective, flexible, plastic slip sheets inherently bonded or adhesive bonded in the manufacturing process of the horizontal-disassociation-cushioning-layer 18, rather than requiring loose slip sheets 21, 22 installed in the field.

Foam rods 20 may be provided, especially with larger tiles, to fill the lower portion of the spaces between tile edges 12 in the manner of a conventional expansion joint, with the dynamic-interactive-fluidtight-elastomeric-sealant 14 being applied above the foam rod 20 as shown. Preferably, the joint defined by foam rod 20 and sealant 14 should have a width between edges 12 so as to be slightly less than the smallest dimension of commonly used spike heel shoes worn by women (i.e., about ¼ inch) so as to preclude damage to dynamic-interactive-fluidtight-elastomeric-sealant-joint 14 or catching the spiked high heel shoe. When tile sizes of 2 inches and less, or even 4 inches and less, on a side are used, it is advantageous to reduce the size of dynamic-interactive-fluidtight-flexible-joints 14 between adjoining horizontal-individual-tiles 10 to approximately 1/16 inch. This smaller joint size is particularly suitable to the layout shown in FIG. 3, where horizontal-individual-tiles 10 are adhered to horizontal-composite-assemblage-sheets 26 for the purpose of holding horizontal-individual-tiles 10 in position when filling dynamic-interactive-fluidtight-flexible-joints 14 between tiles 10 with dynamic-interactive-fluidtight-elastomeric-sealant.

The dynamic-interactive-fluidtight-elastomeric-sealant 14 ties the various horizontal-individual-tiles 10 together so that when one horizontal-individual-tile 10 is depressed by a footstep or the like, the other tiles 10 are carried with it, while causing spreading out of the load, exhibiting flexibility in dynamic-interactive-fluidtight-flexible-joints with compression in top and tension in bottom of the dynamic-interactive-fluidtight-flexible-joint, and then tension in the top and compression in the bottom of the joint due to the dynamic movement of the floating horizontal-individual-tiles 10 as the foot is lifted up, and distributing the stresses throughout several horizontal-individual-tiles 10 to reduce the possibility of rupturing of a dynamic-interactive-fluidtight-flexible-joint or breakage of the horizontal-individual-tile 10.

THE THIRD EMBODIMENT OF THIS INVENTION

Figure 3:
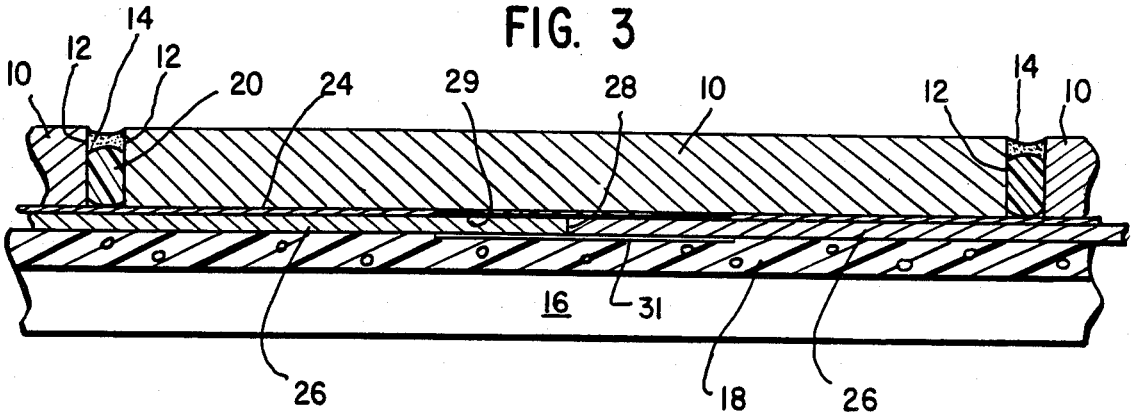
FIG. 3 is an enlarged, transverse sectional view of another embodiment of the tile covering of this invention, resting on a horizontal-base-surface.

Referring to FIG. 3, in this embodiment horizontal-individual-tiles 10 may be selaed with an adhesive layer of conventional thinset tile adhesive 24, with Quar-A-Poxy II as manufactured by H. B. Fuller Co. or Laticrete 4237 as manufactured by Laticrete International being preferred, to an array of abutting, generally highly flexible horizontal-composite-assemblage-sheets 26 floating above horizontal-disassociation-cushioning-layer 18, such as, asbestos board or tempered hardboard, preferably having a thickness of about ⅛ to ¼ inch. A preferred flexible asbestos-cement board is "Flexboard" as manufactured by JohnsManville because of its greater strength to elasticity and flexibility without being brittle, as compared to Belgian-made "Flexweld" as manufactured by Glasweld, which will also function. Thinset adhesive layer 24 may be provided simply to locate horizontal-individual-tiles 10 prior to insertion of the foam rods 20 and dynamic-interactive-fluidtight-elastomeric-sealant 14, to facilitate the edge sealing process by preventing sliding of the horizontal-individual-tiles 10 while installing foam rods 20 and dynamic-interactive-fluidtight-elastomeric-sealant 14. Generally, bonding horizontal-individual-tiles 10 smaller than 6 inches of a side and, particularly, when horizontal-individual-tiles 10 are 2 inches or less on a side, flexible horizontal-composite-assemblage-sheet 26 is particularly desirable as to the mechanics of assembling the system so as to assist the positioning of the horizontal-individual-tiles 10 prior to sealing the dynamic-interactive-fluidtight-flexible-joints. Foam rods 20 may be eliminated and the entire dynamic-interactive-fluidtight-joint 14 filled with elastomeric sealant.

When dynamic-interactive-fluidtight-flexible-joints 14 of horizontal-individual-tiles 10 are not coordinated with edges 28 in the horizontal-composite-assemblage-sheet 26, continuous top and bottom splicing members 29, 31 are desired to retain the adjacent horizontal-composite-assemblage-sheets 26 together. Splicing members 29, 31 may comprise about 20 gauge sheet metal as shown, sealed to the horizonal-composite-assemblage-sheets 26 in an adhering relationship thereto to hold them in position. For horizontal-individual-tiles 10 ½ inch thick and more and greater than 6 inches on a side, the individual horizontal-composite-assemblage-sheets 26 may preferably have edges 28 which abut each other, with the abutting edges being spaced from the tile edges 12 which are in longitudinal relation to abutting edges 28. Accordingly, each tile edge 12 is positioned, with respect to the parallel edges 28 of horizontal-composite-assemblage-sheets 26, in a central position on the horizontal-composite-assemblage-sheet 26 so horizontal-individual-tiles 10 aid in forming a rigid splice in conjunction with top and bottom sheet metal splicing members 29, 31.

While the side edges 28 of horizontal-composite-assemblage-sheets 26 are specifically shown, the relationship of the end edges of the horizontal-composite-assemblage-sheets 26 and the edges 12 of the horizontal-individual-tiles 10 is also preferably similar to that shown with respect to the side edges 28.

Positioned below horizontal-composite-assemblage-sheets 26 is the thickness of horizontal-disassociation-cushioning-layer 18 which may be similar to or identical with the horizontal-disassociation-cushioning-layer 18 previously described above. Horizontal-base-surface 16 is also shown in FIG. 3, being protected from impact sound by the gravity-held-in-place-load-bearing-horizontal-tile-array arrangement disclosed herein.

Dynamic-interactive-fluidtight-elastomeric-sealant 14 and foam rods 20 as shown in FIG. 3 may also be identical to that previously described.

Horizontal-individual-tiles 10 may preferably have the individual horizontal-composite-assemblage-sheets 26 with edges 28 which abut each other aligned so that the joint edges 28 are positioned below tile joints 14 so that any movement in splice joints 29, 31 of horizontal-composite-assemblage-sheet 26 when floor is walked on depends on the dynamic-interactive-fluidtight-elastomeric-sealant 14 to control this movement in order to prevent breaking thin, brittle horizontal-individual-tiles 10 if allowed to span over the splice joints in the horizontal-composite-assemblage-sheets 26 as described previously. By omitting splice joints 29, 31, it is possible to assemble conveniently this new combination of matter into modular-accessible-tiles.

THE FOURTH EMBODIMENT OF THIS INVENTION

Figure 4:
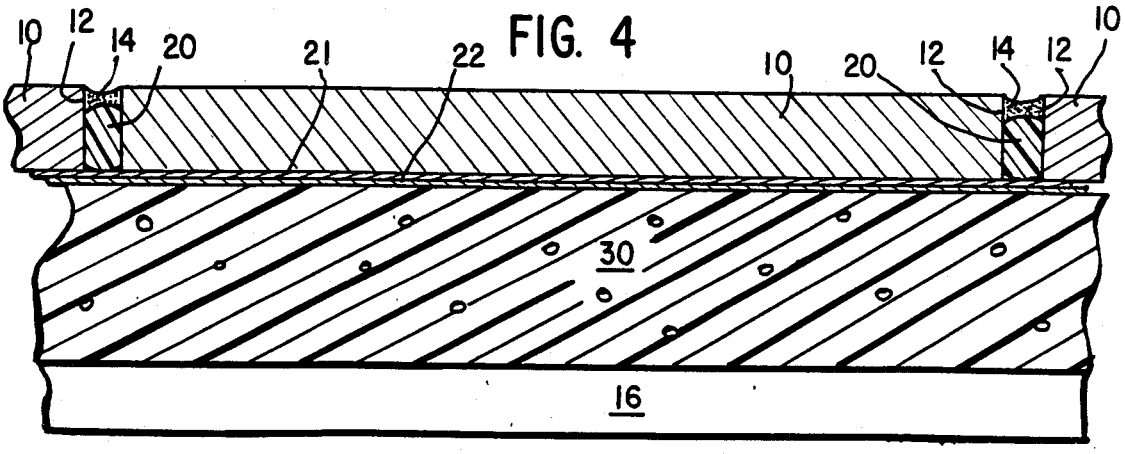
FIG. 4 is an enlarged, transverse sectional view of a third embodiment of the tile covering of this invention, resting on a horizontal-base-surface.

Referring to FIG. 4, horizontal-individual-tiles 10, dynamic-interactive-fluidtight-elastomeric-sealant 14, foam rods 20, and slip sheets 21, 22 may be of a form similar or identical to that previously described with respect to FIG. 2.

In this embodiment, the underlying thickness of horizontal-disassociation-cushioning-layer 18 has been replaced with a thickness of horizontal-rigid-foam-insulation 30, which may be polystyrene foam, for example, and is present in at least a ¾ inch thickness, and is preferably of any thickness functionally required for thermal insulation purposes. As in the previous embodiments, horizontal-individual-tiles 10 are adhesively joined at their edges 12 to adjacent edges 12 of adjoining horizontal-individual-tiles 10 with the bead 14 of dynamic-interactive-fluidtight-elastomeric-sealant. The underlying foam rod 20 is desirably present, as previously described.

Slip sheets 21 and 22, as previously described, may also be provided to protect the horizontal-rigid-foam-insulation 30 from abrasion as horizontal-individual-tiles 10 shift and work on the horizontal-rigid-foam-insulation 30 as they are pressed into the horizontal-rigid-foam-insulation 30. Where greater flexibility is desired, horizontal-disassociation-cushioning-layer 18, as previously described, may also be provided. Horizontal-composite-assemblage-sheet 26, as previously described, may also be provided.

An advantage of this invention is that not only does it provide impact sound isolation, but it provides thermal insulation as well to offset the fact that different temperatures may be desired in the spaces above and below the floor assembly described or to offset the effects of solar heat gain being transmitted from one area to another through the floor assembly.

As in the previous embodiment, the dynamic-interactive-fluidtight-flexible-joints provided by dynamic-interactive-fluidtight-elastomeric-sealant 14 make possible the placement of horizontal-individual-tiles 10 on the horizontal-rigid-foam-insulation 30, without cracking of the horizontal-individual-tiles 10 or the bonds between the horizontal-individual-tiles 10 as the horizontal-rigid-foam-insulation 30 is compressed due to the pressure of footsteps and other stresses, while also achieving the desired impact sound isolation and also thermal insulation.

As a result of this invention, upstairs rooms with tile floors may be utilized in multi-story buildings and other areas where design appearance, personal preferences, sanitation conditions, or economic cost value benefits indicate the need for easily maintained, cleanable tile floors, while at the same time achieving the desired advantage of substantially suppressed transmission of impact noise to the occupied spaces below the tile floor and/or providing thermal insulation between the upper and lower habitable spaces.

The above has been offered for illustrative purposes only and is not intended to limit the invention of this application, which is as defined in the claims below.

I claim:

1. Impact sound isolation of a gravity-held-inplace-horizontal-tile-array of jobsite-installed tiles, comprising, in combination, a horzontal-base-surface, a horizontal-disassociation-cushioning-layer loose laid over said horizontal-base-surface, one or more slip sheets, and a plurality of horizontal-individual-tiles of uniform thickness having a top wearing surface, a bottom surface and three or more sides loose laid and overlying said one or more slip sheets, said tiles being arranged in a patterned layout, joined to one another by means of a dynamic-interactivefluidtight-flexible-joint, and held in place by gravity, friction and accumulated-interactive-assemblage over said horizontal-disassociation-cushioning-layer and said one or more slip sheets so that the assembly is cushioned by said horizontal-disassociation-cushioning-layer and responds dynamically, interactively and accommodatively to foot and rolling traffic, said dynamic-interactive-fluidtightflexible-joint comprising an elastomeric sealant, said impact sound isolation achieved by means of the placement of said horizontal-disassociation-cushioning-layer between the hard top surface of said horizontal-base-surface and the hard bottom surface of said horizontal-individual-tiles and by means of the resilient, dynamic system of said dynamicinteractive-fluidtight-flexible-joint joining said tiles together.

2. The tile array of claim 1 in which said dynamic-interactive-fluidtight-flexible-joint material comprises room-temperature-curing elastomeric sealant materials selected from the group consisting of urethane sealants, polyurethane sealants, silicone sealants, and polysulfide sealants.

3. The tile array of claim 1 in which said horizontal-disassociation-cushioning-layer comprises a flexible elastic foam material selected from the group consisting of urethane foam, polyurethane foam, polyethylene foam, polystyrene foam, latex rubber foam, and solid elastomeric materials.

4. The tile array of claim 1 in which said slip sheet comprises materials selected from the group consisting of polyethylene, polyolefin, plastic, and flexible composition.

5. The tile array of claim 1 in which said horizontal-individual-tiles forming said array comprise rigid tile materials selected from the group consisting of wood, composition materials, cementitious materials, quarry tile, ceramic tile, ceramic mosaic tile, porcelain tile, vitreous tile, pavers, masonry tile, stone tiles, marble, slate, granite, terrazzo, concrete, and plastic.

6. The tile array of claim 1 in which said horizontal-disassociation-cushioning-layer comprises an elastic carpet pad selected from the group consisting of rubberized animal hair, synthetic fiber, India jute, flat sponge rubber, waffled sponge rubber, flat latex rubber, herringbone design rippled sponge rubber, waffled EPDM polymer sponge, and latex foam rubber.

7. The tile array of claim 1 in which said horizontal-disassociation-cushioning-layer comprises a material selected from factory-manufactured rolled, flat and folded sheet, poured-in-place foams from jobsite pouring systems, and sprayed-in-place foams from jobsite spraying systems.

8. The tile array of claim 1 in which one said slip sheet is adhered to the top surface of said horizontal-disassociation-cushioning-layer and one said slip sheet is adhered to the bottom surface of said horizontal-disassociation-cushioning-layer.

9. The tile array of claim 1 in which said one or more slip sheets is inherently bonded in the manufacturing process to said horizontal-disassociation-cushioning-layer.

10. The tile array of claim 1 in which said one or more slip sheets is loose laid.

11. The tile array of claim 1 in which said one or more slip sheets is disposed above said horizontal-disassociation-cushioning-layer.

12. Impact sound isolation of a gravity-held-inplace-load-bearing-tile-array of site-installed tiles, comprising, in combination, a horizontal-base-surface, a flexible horizontal-disassociation-cushioning-layer loose laid over said horizontal-base-surface, a plurality of horizontal-composite-assemblage-sheets loose laid over said horizontal-disassociation-cushioning-layer, and a plurality of horizontal-individual-tiles of uniform thickness having a top wearing surface, a bottom surface, and three or more sides adhered to said horizontal-composite-assemblage-sheets, said tiles being arranged in a patterned layout, joined one to another by means of a dynamic-interactive-fluidtight-flexible-joint, and held in place by gravity, friction and accumulated-interactive-assemblage over said flexible horizontal-disassociation-cushioning-layer so that the assembly is cushioned by said horizontal-disassociation-cushioning-layer and responds dynamically, interactively and accommodatively to foot and rolling traffic, said dynamic-interactive-fluidtight-flexible-joint comprising an elastomeric sealant, said impact sound isolation schieved by means of the loose-laid placement of said horizontal-disassociation-cushioning-layer between the hard top surface of said horizontal-base-surface and the hard bottom surface of said horizontal-composite-assemblage-sheets and by means of the resilient, dynamic system of said dynamic-interactive-fluidtight-flexible-joint joining said tiles together.

13. The tile array of claim 12 in which said horizontal-composite-assemblage-sheet comprises flexible boards selected from the group consisting of asbestos-cement board, tempered hardboard, and composition board.

14. Impact sound isolation and thermal insulation of a gravity-held-in-place-load-bearing-horizontal-tile-array of site-installed tiles, comprising, in combination, a horizontal-base-surface, a horizontal-rigid-foam-insulation-layer loose laid over said horizontal-base-surface, one or more slip sheets loose laid over said horizontal-rigid-foam-insulation-layer, and a plurality of horizontal-individual-tiles of uniform thickness loose laid and overlying said one or more slip sheets, said tiles being arranged in a patterned layout, joined one to another by means of a dynamic-interactive-fluidtight-flexible-joint, and held in place by gravity, friction and accumulated-interactive-assemblage over said horizontal-rigid-foam-insulation-layer and said one or more slip sheets so that the assembly is cushioned by and responds dynamically, interactively, and accommodatively to foot and rolling traffic, said dynamic-interactivefluidtight-flexible-joint comprising an elastomeric sealant, said impact sound isolation and thermal insulation achieved by means of the placement of said horizontal-rigid-foam-insulation-layer between the hard top surface of said horizontal-base-surface and the hard bottom surface of said horizontal-individual-tiles and by means of the resilient, dynamic system of said dynamic-interactive-fluidtight-flexible-joint joining said tiles together.

15. The tile array of claim 14 in which said horizontal-rigid-foam-insulation-layer comprises a rigid-foam-insulation material selected from the group consisting of polystyrene foam board, polystyrene bead board, polyurethane foam board, polyisocyanurate foam board, phenolic foam board, foamed-in-place rigid urethane foam, and urethane pour systems.

16. The tile array of claim 14 in which said horizontal-rigid-foam-insulation-layer diminishes the effects of solar heat gain being transmitted from one occupied space to another through the floor assembly.

17. Impact sound isolation and thermal insulation of a gravity-held-in-place-load-bearing-horizontal-tile-array of site-installed tiles, comprising, in combination, a horizontal-base-surface, a horizontal-rigid-foam-insulation-layer loose laid over said horizontal-base-surface, one or more slip sheets loose laid over said horizontal-rigid-foam-insulation-layer, a plurality of horizontal-composite-assemblage-sheets loose laid over said one or more slip sheets, and a plurality of horizontal-individual-tiles of uniform thickness having a top wearing surface, a bottom surface, and three or more sides adhered to said horizontal-composite-assemblage-sheets, said horizontal-individual-tiles being arranged in a patterned layout, joined one to another by means of a dynamic-interactive-fluidtight-flexible-joint, and held in place by gravity, friction and accumulated-interactive-assemblage over said horizontal-composite-assemblage-sheets, said one or more slip sheets, and said horizontal-rigid-foam-insulation-layer so that said array is cushioned by and responds dynamically, interactively and accommodatively to foot and rolling traffic, said dynamic-interactive-fluidtight-flexible-joint comprising an elastomeric sealant, said impact sound isolation and thermal insulation achieved by means of the placement of said horizontal-rigid-foam-insulation-layer between the hard top surface of said horizontal-base-surface and the hard bottom surface of said horizontal-composite-assemblage-sheets and by means of the resilient, dynamic system of said dynamic-interactive-fluidtight-flexible-joint joining said tiles together.

18. The tile array of claim 17 in which a horizontal-disassociation-cushioning-layer is placed above or below said slip sheet.

19. The tile array of claim 17 in which a horizontal-disassociation-cushioning-layer is sandwiched between and adhered to said horizontal-composite-assemblage-sheet and said horizontal-rigid-foam-insulation-layer.

20. A resilient, dynamic system responding to foot and rolling traffic, comprising, in combination, a horizontal-base-surface, a horizontal-disassociation-cushioning-layer loose laid over said horizontal-base-surface, an array of rigid tiles "floating" by gravity, friction and accumulated-9interactive-assemblage over said horizontal-disassociation-cushioning-layer, said rigid tiles joined to one another by means of a plurality of dynamic-interactive-fluidtight-flexible-joints, the stress from said foot and rolling traffic distributed to surrounding tiles in wavelike damping and dispersing action by means of said dynamic-interactive-fluidtight-flexible-joints and said horizontal-disassociation-cushioning-layer.

* * * * *